US010123927B2

(12) United States Patent
Gilderman

(10) Patent No.: US 10,123,927 B2
(45) Date of Patent: Nov. 13, 2018

(54) KNEE JOINT REHABILITATION ASSIST DEVICE

(71) Applicant: Kerry Douglas Gilderman, Eagan, MN (US)

(72) Inventor: Kerry Douglas Gilderman, Eagan, MN (US)

(73) Assignee: Kneewell LLC, Eagan, MN (US)

( * ) Notice: Subject to any disclaimer, the term of this patent is extended or adjusted under 35 U.S.C. 154(b) by 626 days.

(21) Appl. No.: 14/739,136

(22) Filed: Jun. 15, 2015

(65) Prior Publication Data

US 2015/0374572 A1 Dec. 31, 2015

Related U.S. Application Data

(60) Provisional application No. 62/017,027, filed on Jun. 25, 2014, provisional application No. 62/117,364, filed on Feb. 17, 2015.

(51) Int. Cl.

*A61H 1/02* (2006.01)
*A63B 21/00* (2006.01)
*A63B 23/00* (2006.01)

(52) U.S. Cl.

CPC ..... *A61H 1/024* (2013.01); *A63B 21/00185* (2013.01); *A61H 2201/1269* (2013.01); *A61H 2201/165* (2013.01); *A61H 2205/102* (2013.01); *A63B 2023/006* (2013.01)

(58) Field of Classification Search

CPC ..... A61H 1/024; A61H 2201/165; A61H 2201/1269; A61H 2205/102; A63B 21/00185; A63B 2023/006

See application file for complete search history.

(56) References Cited

U.S. PATENT DOCUMENTS 1,066,190 A * 7/1913 Callanan ..... A61F 5/0585 602/5
4,566,440 A * 1/1986 Berner ..... A61H 1/0255 601/34
4,844,454 A * 7/1989 Rogers ..... A61H 1/024 482/131
4,848,326 A * 7/1989 Lonardo ..... A61F 5/0125 602/26
5,236,333 A * 8/1993 Barba, Jr. ..... A61H 1/024 482/125
5,662,562 A * 9/1997 Wohlenberg ..... A61H 1/024 482/907
5,887,288 A * 3/1999 Arney ..... A42B 3/085 2/417
6,821,262 B1 * 11/2004 Muse ..... A61H 1/024 128/882
6,962,570 B2 * 11/2005 Callanan ..... A61H 1/024 482/95
7,309,305 B2 * 12/2007 Nichols ..... A63B 21/00047 482/148

(Continued)

*Primary Examiner* — Sundhara Ganesan
(74) *Attorney, Agent, or Firm* — C. G. Mersereau; Nikolai & Mersereau, P.A.

(57) ABSTRACT

A knee joint rehabilitation assist device includes a rigid, generally rectangular frame, a heel rest attached across one end of the frame to accommodate a heel of a user, an adjustable knee sling attached at an adjustable distance spaced from the heel rest for accommodating the upper surface of a knee to be rehabilitated, and optionally, an auxiliary thigh strap for controlling pressure applied by the device.

6 Claims, 2 Drawing Sheets

(56) References Cited

U.S. PATENT DOCUMENTS

| | | | | |
|---|---|---|---|---|
| 8,632,480 | B2 | 1/2014 | Gardner et al. | |
| 8,652,074 | B2 | 2/2014 | Doi | |
| 9,498,399 | B1 * | 11/2016 | Juntunen | A61H 1/024 |
| 2003/0034060 | A1 * | 2/2003 | Maxey, Sr. | A61H 3/00 135/68 |
| 2007/0161479 | A1 * | 7/2007 | Harris | A61H 1/024 482/148 |
| 2010/0130893 | A1 * | 5/2010 | Sankai | A61B 5/1071 601/5 |
| 2011/0224585 | A1 * | 9/2011 | Hall | A61H 1/024 601/34 |
| 2012/0323152 | A1 * | 12/2012 | Schubert | A61H 9/0092 601/149 |
| 2014/0018216 | A1 * | 1/2014 | Hatfield | A63B 21/00185 482/131 |

* cited by examiner

KNEE JOINT REHABILITATION ASSIST DEVICE

CROSS-REFERENCED TO RELATED APPLICATIONS

This application is a complete application of prior provisional Application Nos. 62/017,027, filed Jun. 25, 2014, and 62/117,364, filed Feb. 17, 2015, both of which are deemed incorporated herein by reference in their entirety.

STATEMENT REGARDING FEDERALLY SPONSORED RESEARCH OR DEVELOPMENT

Not applicable

BACKGROUND OF THE INVENTION

I. Field of the Invention

The present invention relates generally to orthopedic devices and, in particular, to a device used in the exercising of a knee following injury or surgery, particularly to aid in the rehabilitation process following a total knee replacement.

II. Related Art

The prior art is replete with orthopedic devices for aiding physical therapy related to knee joint exercising following a surgical procedure such as a total knee replacement. For the most part, such devices are complex mechanical structures. One such structure to support and more the lower leg is shown in U.S. Pat. No. 8,632,480 to Gardner et al. In U.S. Pat. No. 8,652,074 B2 to Doi, there is shown a walking assist device that attaches to the upper and lower portions of a user's leg with a rotary joint located there between. The rotary joint is aligned with the user's knee and an actuator swings the lower link relative to the upper link. A controller is used to control the actuator so that the lower link guides the user's walking motion.

While many of the existing devices have been helpful in various stages of rehabilitation, there remains a definite need for a relatively simple device to interact with the user to help achieve full knee flexion and extension of the recovering knee joint.

SUMMARY OF THE INVENTION

By means of the present invention, there is provided a relatively simple device operable by a patient to assist in rehabilitating a post-operative knee. The device includes a rigid generally rectangular frame supplied with a heel rest slipped over one end of the rectangular frame. A knee sling is adjustably located spaced from the heel rest along the rectangular frame at a point where it will contact the upper surface of a knee of the user. An optional thigh strap may be located spaced from the knee sling along the rectangular frame.

The rectangular frame may be formed from aluminum tubing or other metal or any relatively rigid material. The heel rest is in the form of a pocket containing a soft foam insert such as a foam rubber pad sealed in the pocket as by a hook and loop fastening system such as that known as Velcro® as an easily opening and closing device. Likewise, the knee sling component also may include an adjustable pocket with a foam, such as foam rubber, insert also sealed by a removable hook and loop system. The thigh strap is wrapped around the upper portion of the rectangular frame and is used to aid in operating the device.

To operate the device, the heel is placed in the heel rest at what is the bottom of the device as used with the patient sitting on the edge of a chair or possibly on the floor. The knee sling is adjusted to the middle or top of the knee and the patient pushes the side bars down causing downward flexion of the joint and reducing the degree of contracture, extending the knee joint.

BRIEF DESCRIPTION OF THE DRAWINGS

In the drawings wherein like numerals indicate like parts throughout the same.

DETAILED DESCRIPTION

The following detailed description describes embodiments that include concepts of the present development. Those embodiments are meant as examples only and are not intended to limit the scope of the present invention in any manner as variations of the development will occur to those skilled in the art.

Figure 1:
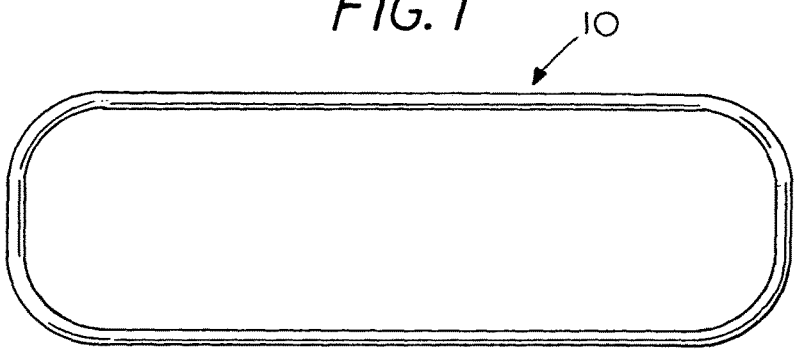
FIG. 1 is a drawing of a frame element for the knee joint rehabilitation assist device of the invention.

FIG. 1 depicts a generally rectangular tubing structure 10 which serves as the frame for the knee joint rehabilitation device of the invention. One such frame was made of 1 inch diameter aluminum tubing bent and welded to create a continuous generally rectangular structure. Of course, other fasteners such as rivets may also be used. One such structure was 34 inches (86.36 cm) long by 10 inches (25.4 cm) wide. However, it will be appreciated that the frame can be any desired size and constructed of any useful rigid material. A 36 inch (91.4 cm) model and a 32 inch (81.28 cm) have also been demonstrated.

Figure 2:
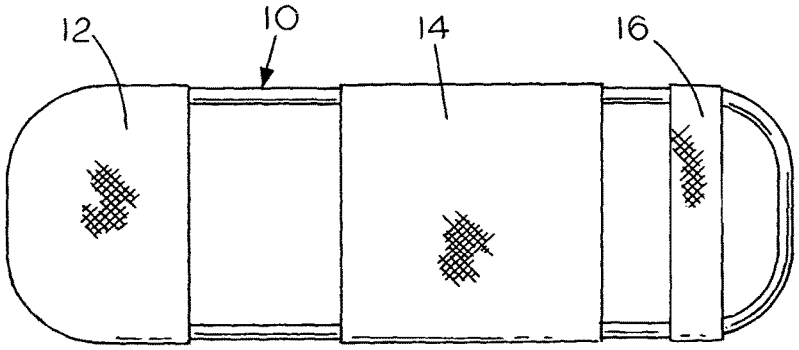
FIG. 2 is a schematic drawing showing the parts of the knee join rehabilitation assist device as assembled.
Figure 3:
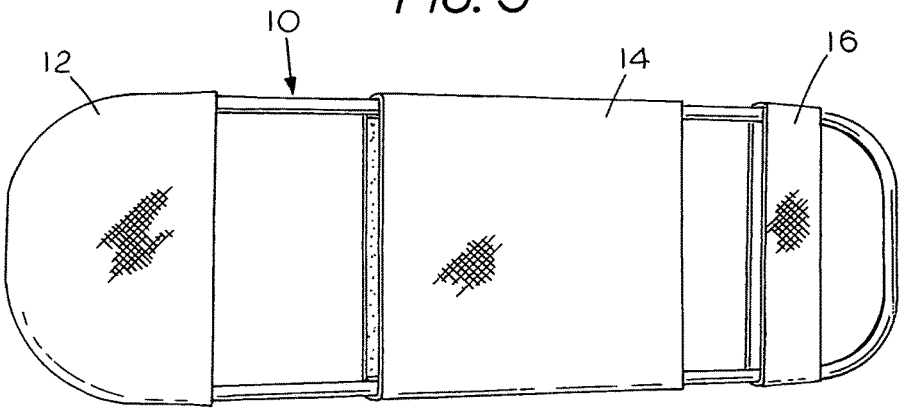
FIG. 3 is a photograph of an assembled knee joint rehabilitation assist device.

FIG. 2 is a schematic drawing showing the knee joint rehabilitation aid of the invention, including the frame 10 with the heel rest 12 located at one end of the frame. A knee sling 14 is shown intermediate the ends of the frame and it is configured so it is adjustable there along to accommodate the knee of the user depending on the distance between the heel and the knee. An adjustable pressure strap 16 is shown toward what becomes the upper end of the device fastened around the thigh of the user and over the upper end portion of the frame. A picture of an assembled device is shown in FIG. 3.

Figure 4:
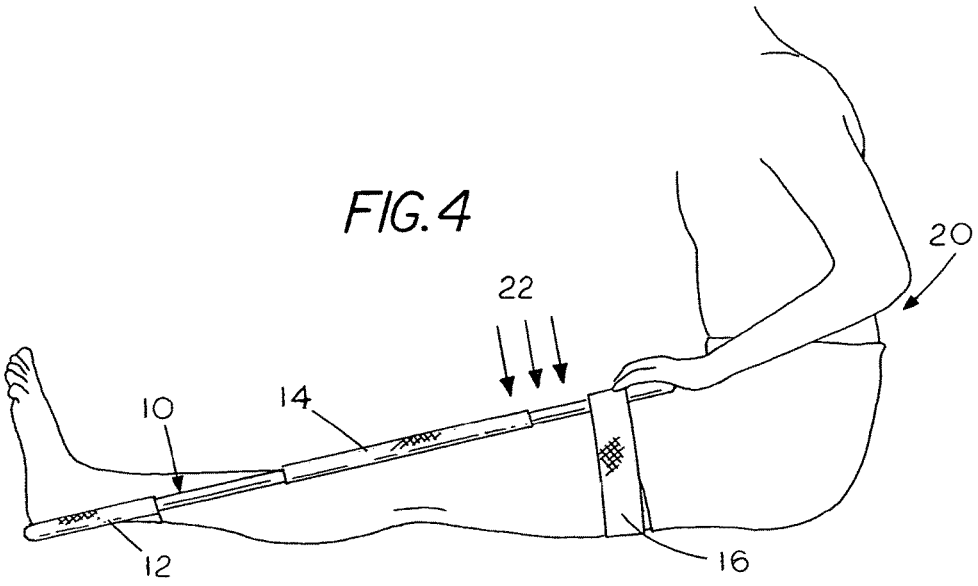
FIG. 4 depicts the knee joint rehabilitation assist device in use.

FIG. 4 depicts an embodiment of the knee joint rehabilitation aid of the invention as employed by a user 20. In use, the patient inserts the lower leg through the gap between the heel rest 12 and the knee sling 14 so that the heel is at or near what becomes the bottom of the device. The knee sling 14 can then be adjusted to meet the middle of the knee such that downward pressure on the sides of the upper portion of the frame stretches the leg toward full extension. The pressure strap 16 can then be tightened around the upper portion of the frame to adjust the tension on the leg and knee joint as desired as the amount of tension and, therefore, generally, the amount of pain endured by the patient depends on the amount of downward pressure 22 applied on the upper portion of the frame.

It will be appreciated that the knee joint rehabilitation aid of the invention is a simple manual device that provides an important therapy to a patient following, for example, total knee arthroplasty (total knee replacement) or reconstructive knee surgery. When used as prescribed, the device will aid greatly to alleviate and return knee flexion contracture prevalent in all stages of the rehabilitation process with the aim being total extension of the knee joint or complete straightening of the leg. The device is designed to be used after the incision on the top of the knee is significantly healed (4-6 weeks) and the patient is able to put significant weight on the affected leg.

It will be recognized that the most common complication associated with the rehabilitation process following a TKR (total knee replacement) is the pain experienced during leg flexion exercises. The basic goal for rehabilitation is to attain 145° of flexion and 0° of flexion contracture or extension as that will allow the patient to achieve a normal walking gait and resume normal activities, it being recognized that the sheer pain involved in this therapy process makes some patients stop the rehabilitation process altogether before a normal walking gait is realized.

Waiting too long, on the other hand, not only makes it impossible to achieve a normal walking gait, but may also lead to associated problems with hips, back and continued knee pain. While the knee joint rehabilitation assist device of the invention does not remove the pain from the process, it does allow the patient to rehabilitate the knee at his or her own pace with as much or little pain as he can stand on any certain day. The device is designed to be used with the patient sitting on the edge of a chair or on the floor and, with the aid of the pressure strap, can provide the desired constant soft tissue stretch, which is very important.

Because the device is operated manually, the patient decides just how much downward pressure to apply directly to the top of the knee joint in order to gain the last ten to fifteen degrees of gait flexion contracture. This thereby restores the full use of the leg and the normal walking gait. The process can be repeated for as long or as many times daily as the patient feels necessary, considering comfort level until 0° of flexion is achieved. The device is designed to be a secondary device used in conjunction with a full rehabilitation regimen.

An important aspect of the design of the device, including the rectangular shape of the frame, prevents a patient from putting too much downward pressure on the knee that may result in hyper-extension and possible damage to the healing joint. The top of the frame is designed to rest on the thigh before the joint goes past 20° or full straightening.

One material preferred to make the knee sling and the heel rest is cotton denim, however, this can be made of any desirable durable fabric. One heel rest used is a pouch containing about 1½ inches (3.8 cm) of foam rubber and has a top which folds over and is sealed with the hook and loop material. Likewise, the knee sling may also have 1½ inch (3.8 cm) foam rubber in the middle and be sealed with a hook and loop system which allows for easy removal and replacement of the foam if desired. Of course, other materials beside foam rubber are contemplated and any material having similar properties can be used.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An optionally hands free knee joint rehabilitation assist device to promote straightening of the knee joint comprising:

(a) a metal frame in the form of a continuous, completely rigid, generally rectangular unit;

(b) a heel rest attached across a distal end region of the frame to accommodate a heel of a user;

(c) a single adjustable knee sling attached at an adjustable distance spaced from the heel rest for accommodating and applying pressure directly to the upper surface of a knee to be rehabilitated; and (d) a control strap in the form of an adjustable thigh strap attached toward a proximal end of the frame for enclosing the user's thigh and optionally controlling downward pressure applied to the proximal end of the frame and upper surface of the knee by the knee sling and corresponding upward force applied to the heel rest.

2. A knee joint rehabilitation assist device as in claim 1 wherein said metal frame is fabricated from aluminum tubing.

3. A knee joint rehabilitation assist device as in claim 1 wherein said heel rest and knee sling comprise cloth pouches filled with a resilient material.

4. A knee joint rehabilitation assist device as in claim 3 wherein said cloth pouches have hook and loop closures.

5. A knee joint rehabilitation assist device as in claim 3 wherein said resilient material is a foam material.

6. A knee joint rehabilitation assist device as in claim 1 wherein said knee sling is wide enough to cover an entire knee joint.

* * * * *